US008931116B2

(12) United States Patent
Lucero

(10) Patent No.: US 8,931,116 B2
(45) Date of Patent: Jan. 13, 2015

(54) PRE-KNOTTED ADJUSTABLE NECKTIE

(71) Applicant: Adam Lucero, Anchorage, AK (US)

(72) Inventor: Adam Lucero, Anchorage, AK (US)

( * ) Notice: Subject to any disclaimer, the term of this patent is extended or adjusted under 35 U.S.C. 154(b) by 0 days.

(21) Appl. No.: 13/770,021

(22) Filed: Feb. 19, 2013

(65) Prior Publication Data

US 2014/0230126 A1 Aug. 21, 2014

(51) Int. Cl.
*A41D 25/02* (2006.01)
*A41D 25/06* (2006.01)
*A41D 25/00* (2006.01)

(52) U.S. Cl.
CPC ..... *A41D 25/06* (2013.01)
USPC ..... 2/150; 2/152.1; 2/149; 2/137; 24/66.11

(58) Field of Classification Search
CPC ... A41D 25/022; A41D 25/02; A41D 25/008; A41D 25/025; A41D 25/003; A41D 25/006; A41D 25/027; A41D 25/04
USPC ..... 2/150, 152.1, 149, 137; 24/66.11
See application file for complete search history.

(56) References Cited

U.S. PATENT DOCUMENTS

| | | | | | |
|---|---|---|---|---|---|
| 1,349,486 | A | * | 8/1920 | Bakerman | 2/150 |
| 1,624,737 | A | * | 4/1927 | Jensen | 2/150 |
| 1,972,405 | A | * | 9/1934 | Less | 2/150 |
| 2,040,297 | A | * | 5/1936 | Costantini | 2/150 |
| 2,052,522 | A | * | 8/1936 | Wagenfeld | 2/150 |
| 2,063,511 | A | * | 12/1936 | Less | 2/150 |
| 2,103,456 | A | * | 12/1937 | Hall | 2/150 |
| 2,129,657 | A | * | 9/1938 | Draper | 2/150 |
| 2,133,296 | A | * | 10/1938 | Holzknecht | 2/153 |
| 2,142,322 | A | * | 1/1939 | Martin | 2/153 |
| 2,244,692 | A | * | 6/1941 | Hall | 2/150 |
| 2,247,184 | A | * | 6/1941 | Burfening | 2/150 |
| 2,408,455 | A | * | 10/1946 | Taborski et al. | 2/150 |
| 2,534,669 | A | * | 12/1950 | Hall | 2/150 |
| 2,605,473 | A | * | 8/1952 | Halsey | 2/153 |
| 2,735,105 | A | * | 2/1956 | Traub | 2/150 |
| 2,907,045 | A | * | 10/1959 | O'Reilly | 2/150 |
| 2,919,444 | A | * | 1/1960 | Stewart | 2/150 |
| 2,936,462 | A | * | 5/1960 | Williams, Jr. et al. | 2/150 |
| 3,146,467 | A | * | 9/1964 | Levko | 2/153 |
| 3,346,881 | A | * | 10/1967 | Mathison | 2/150 |
| 3,665,519 | A | * | 5/1972 | Calhoun, Sr. | 2/150 |
| 3,745,614 | A | * | 7/1973 | Tsang | 2/148 |
| 3,898,698 | A | * | 8/1975 | Byrd et al. | 2/150 |
| 3,942,192 | A | * | 3/1976 | Harris | 24/66.3 |
| 3,958,277 | A | * | 5/1976 | Girdler | 2/153 |
| 3,999,222 | A | * | 12/1976 | Walborn | 2/150 |
| 4,024,585 | A | * | 5/1977 | Girdler | 2/153 |
| 4,035,873 | A | * | 7/1977 | Epperson | 24/66.9 |
| 4,059,853 | A | * | 11/1977 | Girdler | 24/66.4 |
| 4,573,219 | A | * | 3/1986 | Hooten | 24/66.3 |
| 4,615,048 | A | * | 10/1986 | Gasser | 2/153 |
| 5,008,981 | A | * | 4/1991 | Smithson | 24/66.9 |
| 5,035,002 | A | * | 7/1991 | Knight, Jr. | 2/153 |

(Continued)

*Primary Examiner* — Bobby Muromoto, Jr.
(74) *Attorney, Agent, or Firm* — Meister Seelig & Fein LLP

(57) ABSTRACT

A pre-knotted adjustable necktie is provided that includes a pre-knot and a tie body worn about a collar by a person, tie body having a first and second end as well as a front and back to accommodate a surface design and pre-knot having a cover accommodating a cover surface design wrapped about a pre-knot form having channels, a cavity and hooked ends to hold and accommodate the insertion of a tie body making an individual fashion statement over coming the limitations of the modern day necktie.

13 Claims, 11 Drawing Sheets

(56) References Cited

U.S. PATENT DOCUMENTS

| | | | | |
|---|---|---|---|---|
| 5,084,916 | A * | 2/1992 | Austin | 2/149 |
| 5,216,757 | A * | 6/1993 | Dorkin | 2/152.1 |
| 5,416,926 | A * | 5/1995 | Koy | 2/153 |
| 5,493,731 | A * | 2/1996 | Amnott | 2/148 |
| 5,584,075 | A * | 12/1996 | Bae et al. | 2/152.1 |
| 5,920,907 | A * | 7/1999 | Pierce | 2/152.1 |
| 6,094,746 | A * | 8/2000 | Miller | 2/152.1 |
| 6,305,025 | B1 * | 10/2001 | Pilon | 2/145 |
| 6,412,673 | B1 * | 7/2002 | Chuang | 223/82 |
| 6,920,642 | B2 * | 7/2005 | Dickens | 2/152.1 |
| 7,770,238 | B2 * | 8/2010 | Dayan | 2/148 |
| 2002/0095713 | A1 * | 7/2002 | Bonano et al. | 2/149 |
| 2004/0017085 | A1 * | 1/2004 | Daniels | 289/1.2 |
| 2005/0120461 | A1 * | 6/2005 | Dickens | 2/144 |
| 2005/0204450 | A1 * | 9/2005 | Dayan | 2/148 |
| 2007/0033703 | A1 * | 2/2007 | Tao | 2/144 |
| 2008/0109932 | A1 * | 5/2008 | Maleson | 2/148 |
| 2009/0144945 | A1 * | 6/2009 | Funk | 24/66.9 |
| 2009/0260128 | A1 * | 10/2009 | Marzano | 2/145 |
| 2010/0242152 | A1 * | 9/2010 | Dayan | 2/148 |
| 2012/0185995 | A1 * | 7/2012 | Fear | 2/152.1 |

* cited by examiner

PRE-KNOTTED ADJUSTABLE NECKTIE

BACKGROUND OF THE INVENTION

The present application relates to neckties in particular to neckties that are worn for ornamental purposes.

The origin of neckties is more than just fashion history, they are a part of world history, and have been know for ages. It is interesting to note that the army of terracotta warriors unearthed in China in the 1970's are adorned with neckties as well as are some Roman military soldiers shown in paintings from 101 to 106 BC.

More recently, in Croatia the necktie appeared as a form of military fashion and was know as a cravat. Cravat is the word used for necktie in most European languages down to this day. King Louis XIV of France popularized the cravat and modern day decorative neckties have their origin in this popularization.

In 1924 the modern necktie, we know today, emerged in the United States. Through most of the $20^{th}$ century a man was not formally dressed until he put on his necktie. By the end of the $20^{th}$ century the necktie came to symbolize individuality as much as conformity. Since 1995, in tandem with the dotcom boom, necktie sales have declined with the growing casual look in the workplace. In addition, few neckties have been introduced since 1924 that go beyond the limitations of the modern day necktie with its bias cut and three-piece construction.

The modern day necktie is limited to be tied in a single knot or the more popular Windsor styles of knotting. These knots limit the fashion look. The fashion look is limited by the fact that the knot of the necktie will always display the same surface pattern as the body of the necktie. A further limitation is that if the body of the necktie has a diagonal pattern. The pattern of the knot is, always a repetition of the pattern of the body of the necktie, only in the opposite direction.

Neckties are an accessory of clothing that modern day men seem to love or hate. It can be said, of those men that hate the necktie, the primary reason for doings so is the difficulty in tying the knot, as well as having a knot tight to the neck. Lack of design availability to represent the individual is also a consideration.

Various attempts and ineffective solutions have been made to resolve the above issues, such as, the clip on or zipper necktie. While these neckties have a pre-tied knot they do not address the limitations of a knot being able to have an adjustable location or unique surface pattern fashion look. None of these ties have helped the decline of necktie sales and have not contributed to the style or desire of the emerging individual in our global culture.

Accordingly there is a need for a pre-knotted adjustable necktie that overcomes the limitations of the modern day necktie, and its variations, as noted above.

SUMMARY OF THE INVENTION

The present application provides a pre-knotted adjustable necktie that includes: an elongated tie body having a first end and a second end; a pre-knot form having a first channel and a second channel each extending from a top of the pre-knot form to a bottom of the pre-form, wherein the first and second channels each accept one of the first end and the second end of the tie body in a sliding arrangement so as to provide an adjustable loop to be worn around a user's neck; and a pre-knot cover, wherein the pre-knot cover is folded over the pre-knot form laterally so as to conceal a front of the pre-knot form that is exposed when the necktie is worn.

In one embodiment, the pre-knot form comprises a conical structure with a cavity therein, and wherein the channels pass through a top and a bottom of the structure.

In one embodiment, the conical structure is open at a back end of the pre-knot form.

In one embodiment, the conical structure comprises a pair of hooked ends that retain therein the tie body.

In one embodiment, the conical structure is an elliptical conical structure.

The pre-knotted adjustable necktie of claim 5, wherein a top and a bottom of the structure each has an elliptical cross section with dimensions at the top greater than dimensions at the bottom of the structure.

In one embodiment, the pre-knot form comprises a top and a form body attached to each other.

In one embodiment, the top of the pre-knot form having a plurality of apertures representing openings for the channels.

In one embodiment, the form body comprises a plurality of sockets that engage with corresponding clips on the top of the pre-knot form.

In one embodiment, the pre-knot cover is formed as a sheet of material.

In one embodiment, the pre-knot cover has an elongated shape with a first end laterally opposite the first end, and wherein the cover is attached at the first end to a back of the pre-knot form, passed laterally over the front of the pre-knot form, to the back of the pre-knot form.

In one embodiment, the pre-knot cover further passed from the back of the pre-knot form, over the top of the form, and terminating under the pre-knot cover at the front of the form.

In one aspect, a pre-knotted adjustable necktie including: an elongated tie body having a first end and a second end; a pre-knot form an elliptical conical structure with a cavity therein forming a first channel and a second channel each extending from a top of the pre-knot form to a bottom of the pre-form, wherein the first and second channels each accept one of the first end and the second end of the tie body in a sliding arrangement so as to provide an adjustable loop to be worn around a user's neck; and a pre-knot cover, wherein the pre-knot cover is folded over the pre-knot form laterally so as to conceal a front of the pre-knot form that is exposed when the necktie is worn.

Additional aspects of the present invention will be apparent in view of the description which follows.

DETAILED DESCRIPTION OF THE INVENTION

Figure 1:
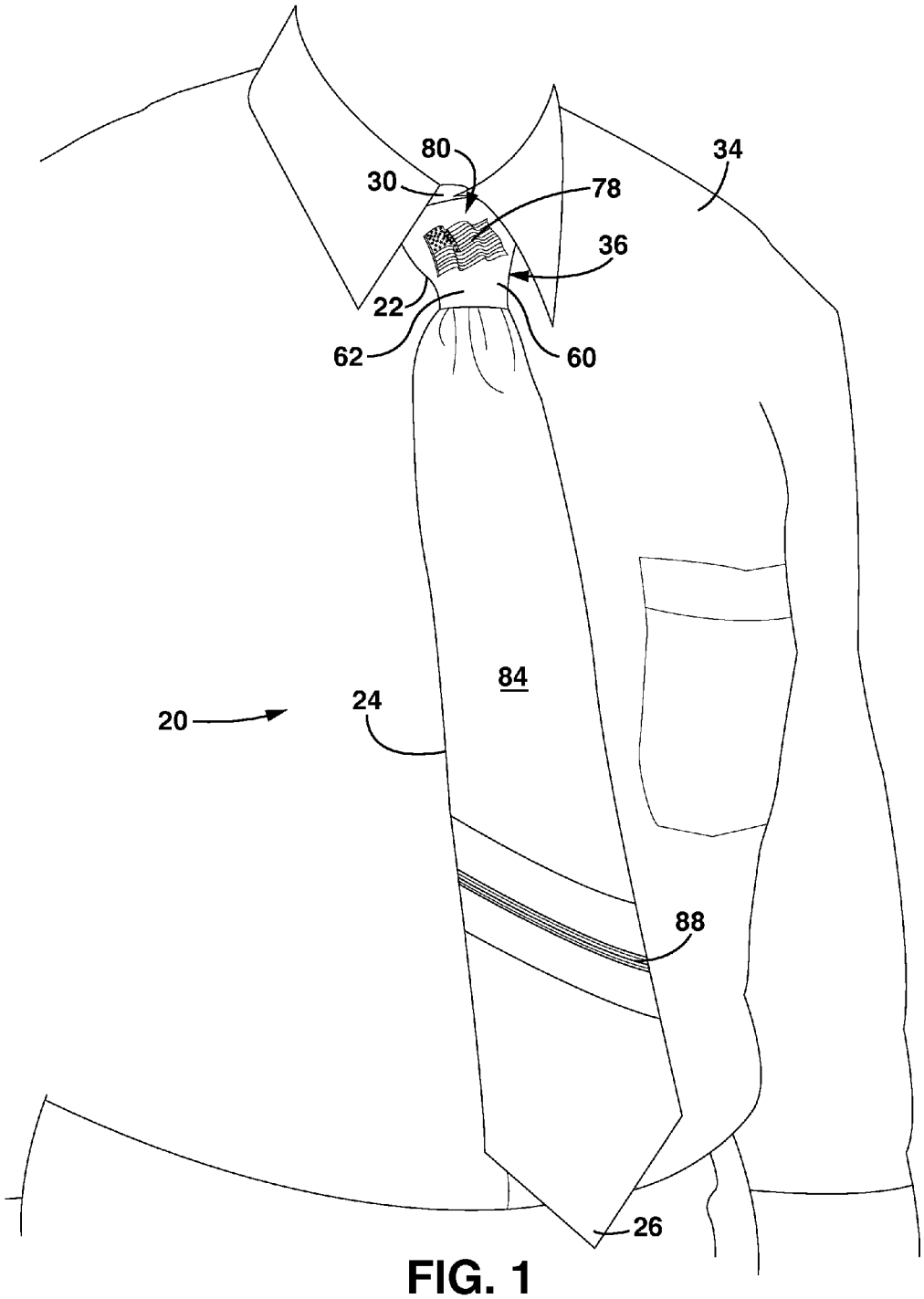
FIG. 1 is a perspective view of the pre-knotted adjustable necktie wearable about a closed collar.
Figure 2:
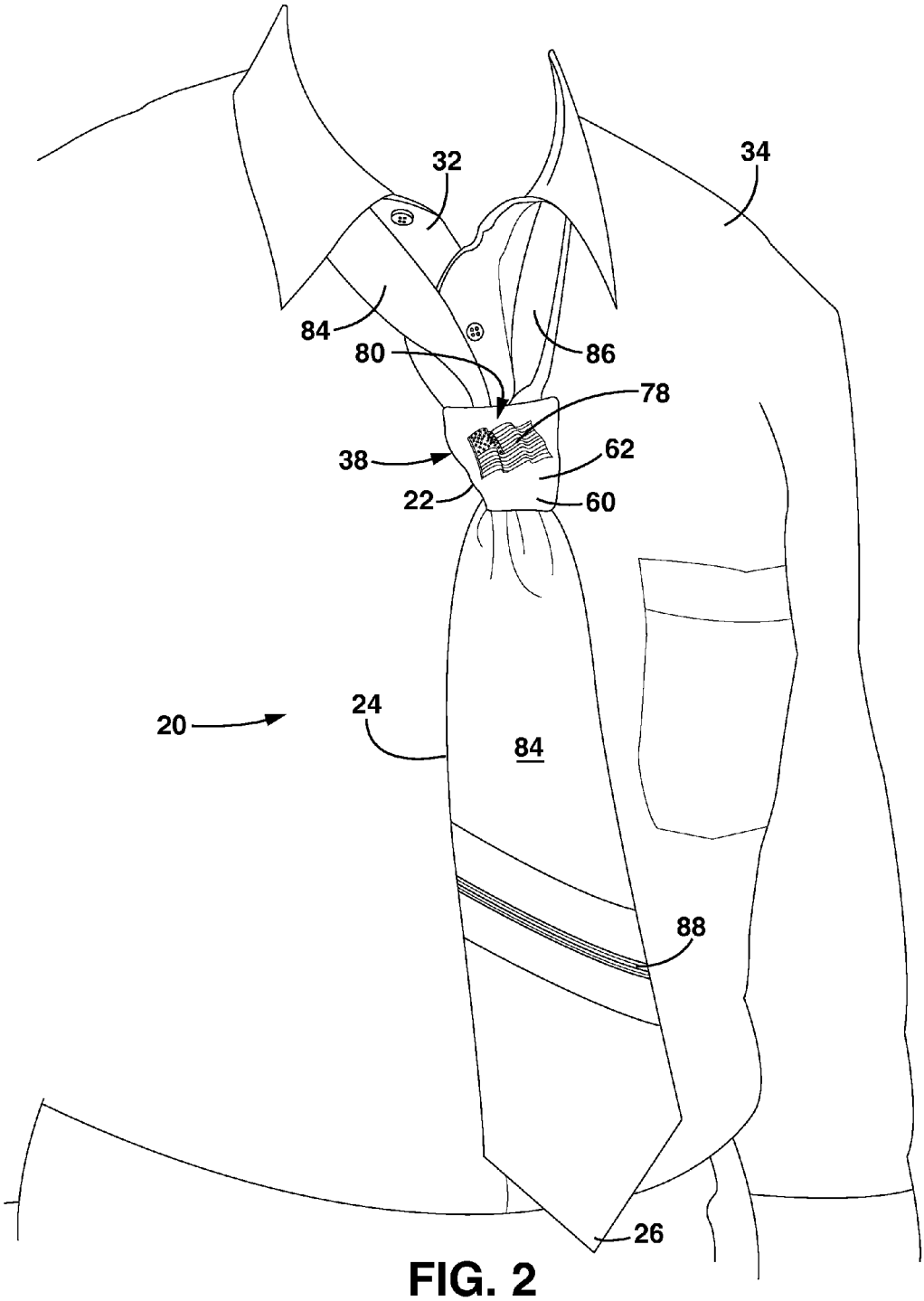
FIG. 2 is a perspective view of the pre-knotted adjustable necktie wearable about an open collar.

Referring to FIG. 1 a perspective view of the pre-knotted adjustable necktie 20 worn about a closed collar 30 and FIG. 2 a perspective view of the pre-knotted adjustable necktie 20 worn about an open collar 32. The modern day necktie with its bias cut and three-piece construction is mimicked by the pre-knotted adjustable necktie 20, as can be seen in FIG. 1 with the pre-knot 22 in its first position 36 about a closed collar 30 of a shirt or blouse worn by a person 34. In FIG. 2 it can be seen that the pre-knot 22 may have an alternate position 38 about the tie body 24. An advantage of the pre-knotted adjustable necktie 20 is the fact that alternate position 38 can be adjusted to an infinite number of locations along the tie body 24 to suit the comfort and fashion mood of the person 34 wearing the pre-knotted adjustable necktie 20. Thus creating a fashion statement that cannot be provided by the structure of the modern day necktie.

Figure 10:
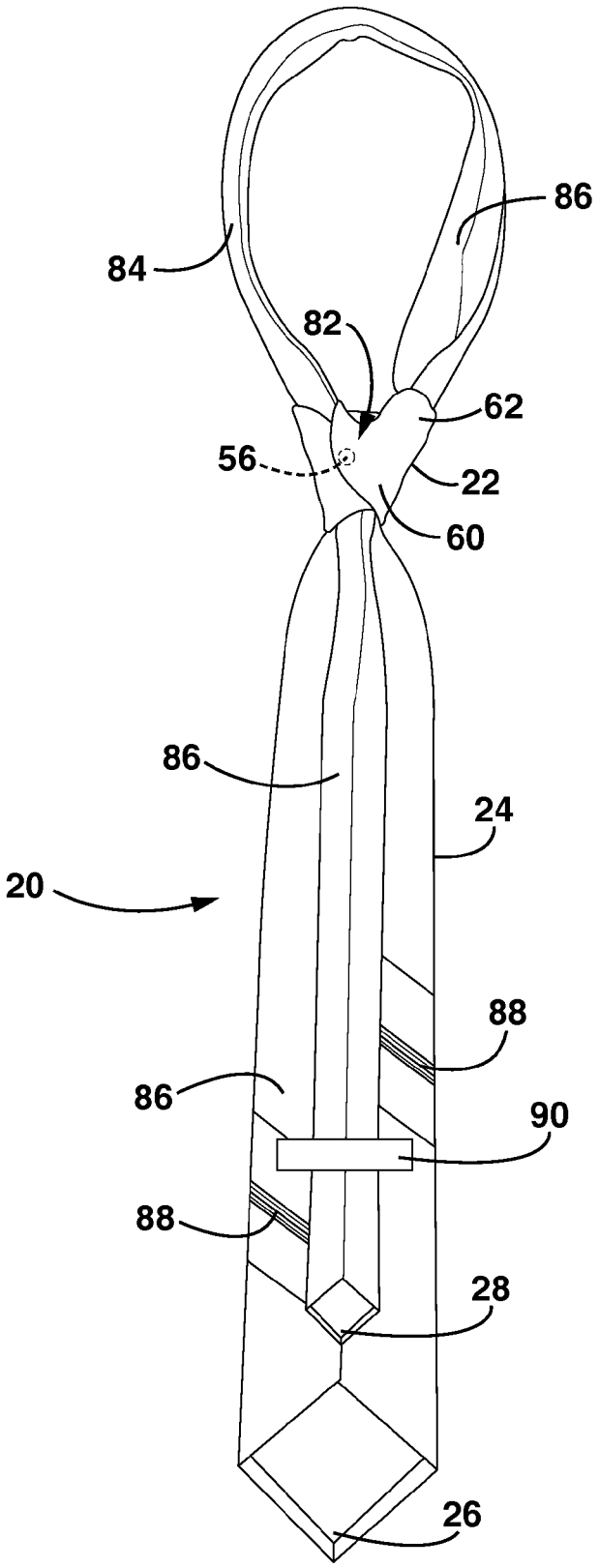
FIG. 10 is a back view of the pre-knotted adjustable necktie.
Figure 11:
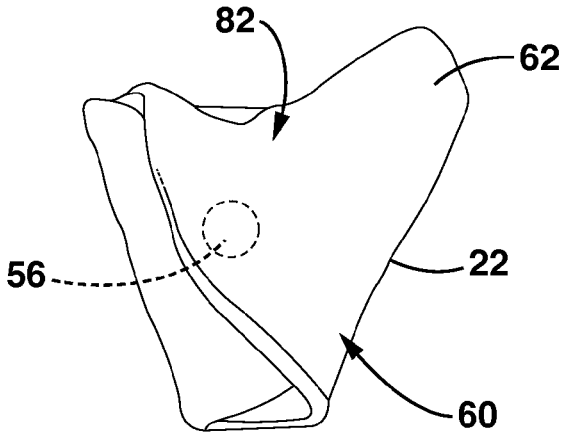
FIG. 11 is a back view of the pre-knot.
Figure 16:
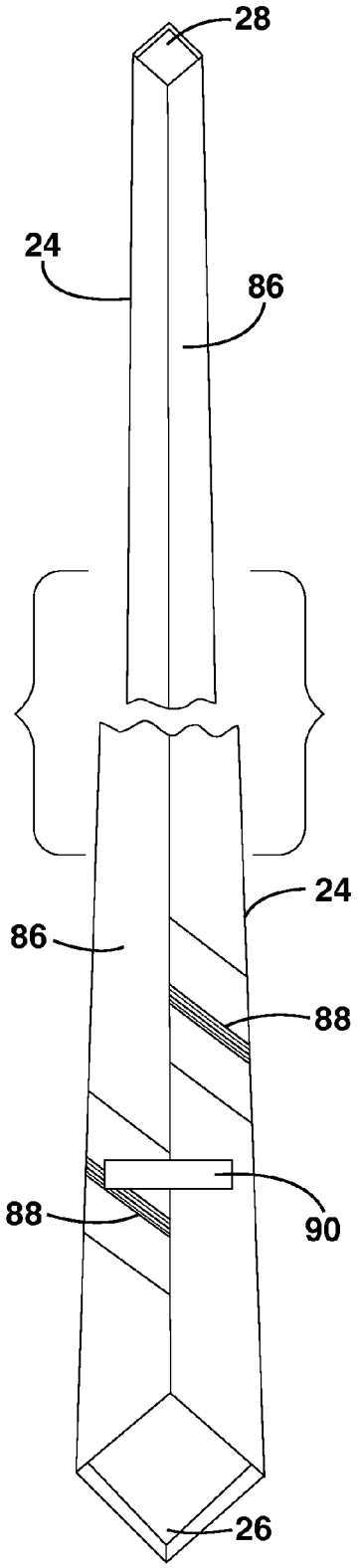
FIG. 16 is a back view of the tie body.

Referring, still further, to FIG. 10 a back view of a pre-knotted adjustable necktie 20 and FIG. 16 a back view of a tie body 24, it can be seen that a tie body 24 has the first end 26 and the second end 28. A first end 26 and a second end 28 are shown terminating in a point but could also terminate in any shape such as, a flat, arc, circular or spline curve shape. A tie body 24 has the tie body front 84 and the tie body back 86. A tie body 24 can be any solid color or have the tie body surface design 88. While an embodiment of a tie body surface design 88 is shown, a tie body surface design 88 can be any infinite combination of colors, lines, shapes or forms applicable to tie body 24. In one embodiment a tie body 24 can be about 46 inches in length and have a varying width of about 1.5 inches to about 3.5 inches. In other embodiments, a tie body 24 can be of any length or widths. In one embodiment a tie body 24 is constructed of fabric in other embodiments any suitable material can be used such as plastic, carbon fiber or woven material. In one embodiment a tie body 24 is made like a modern day necktie with its bias cut and three-piece construction. In other embodiments a tie body 24 could be constructed in any way. Such as, cut from a single sheet of material, made from recycled material, designed in other shapes or assembled with four or more pieces. A tie body 24 may or may not have the ribbon 90 attached to tie body back 86. The purpose of a ribbon 90 is to secure a tie second end 28 as a pre-knotted adjustable necktie 20 is worn by a person 34.

A pre-knot 22, as shown in the drawings, can be any solid color or have the cover surface design 78 on the pre-knot front 80. While an embodiment of a cover surface design 78 is shown. A cover surface design 78 can be any infinite combination of colors, lines, shapes or forms applicable to cover surface design 78. Another advantage of the pre-knot 22 is its ability to have a fashion look unavailable with other modern day neckties. A cover surface design 78 can be a symbol or picture such as shown in FIG. 1 and FIG. 2. Modern day neckties are not able to duplicate this look because they cannot be tied in a configuration to display a symbol or picture on the front of the knot of the modern day necktie. In addition, the pre-knot 22 can over come the limitation of the fact that if the body of the modern day necktie has a diagonal pattern. The pattern of the knot is, always a repetition of the pattern of the body of the necktie, only in the opposite direction. This limitation is over come by the pre-knot cover 60 constructed separate from the tie body 24. Thus, making available more fashion and cover surface designs 78, on the pre-knot 22, than can ever be available on the knot of the modern day necktie, with its construction limitations.

Figure 3:
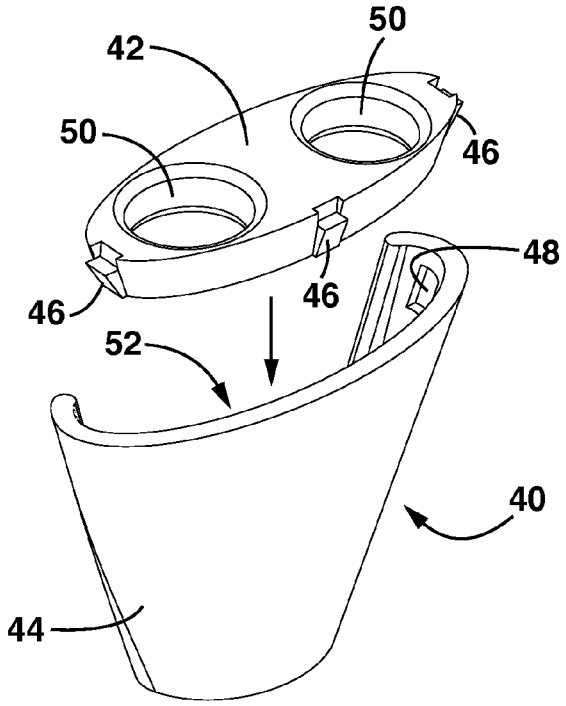
FIG. 3 is an exploded perspective view of the pre-knot form.
Figure 4:
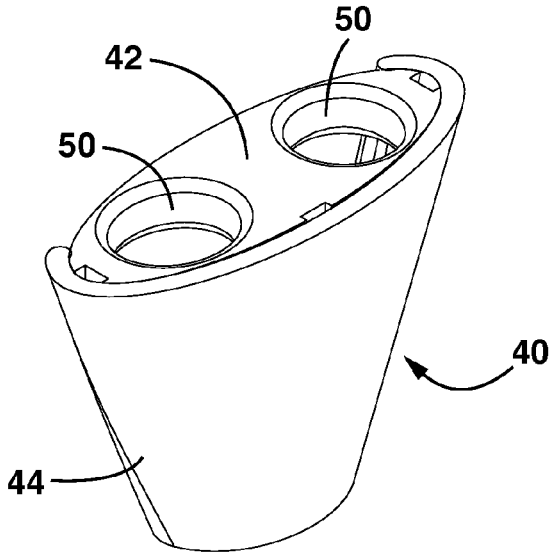
FIG. 4 is an assembled perspective view of the pre-knot form.
Figure 5:
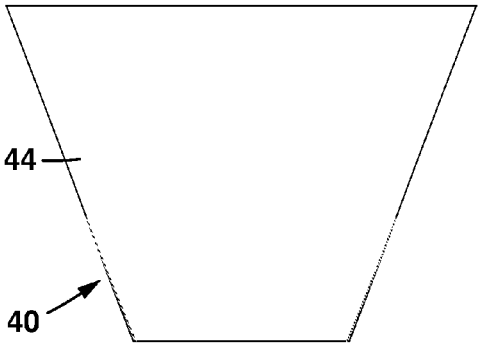
FIG. 5 is a front view of FIG. 4.
Figure 6:
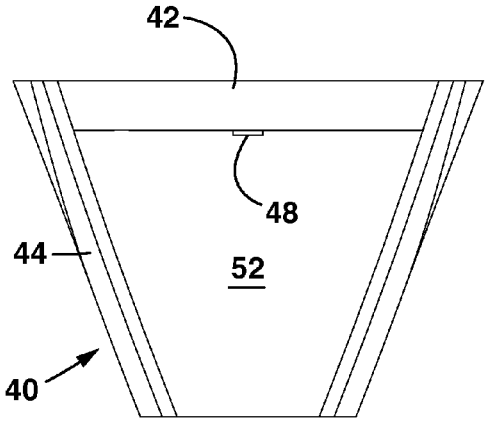
FIG. 6 is a back view of FIG. 4.
Figure 7:
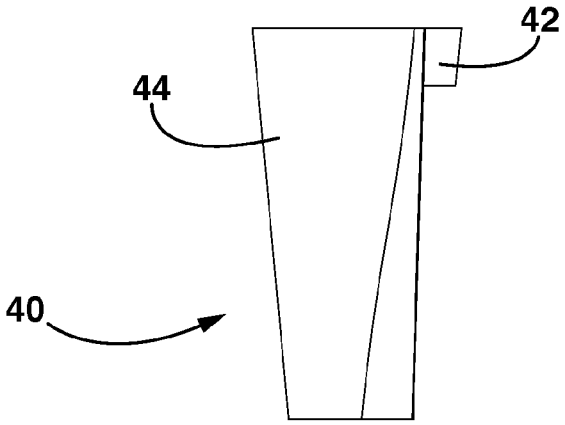
FIG. 7 is a right side view of FIG. 4, left side being equal but opposite.
Figure 8:
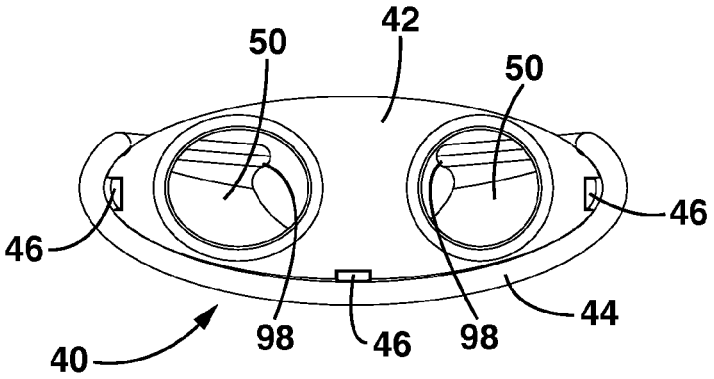
FIG. 8 is a top view of FIG. 4.
Figure 9:
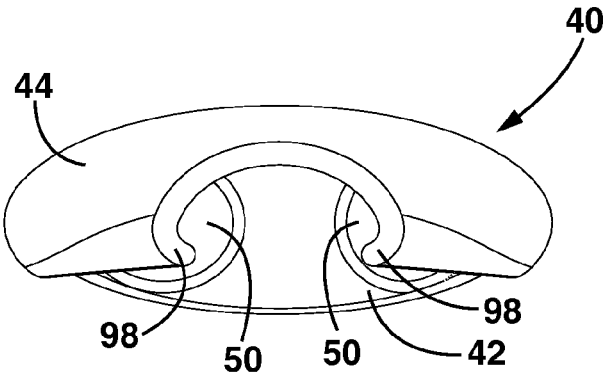
FIG. 9 is a bottom view of FIG. 4.
Figure 17:
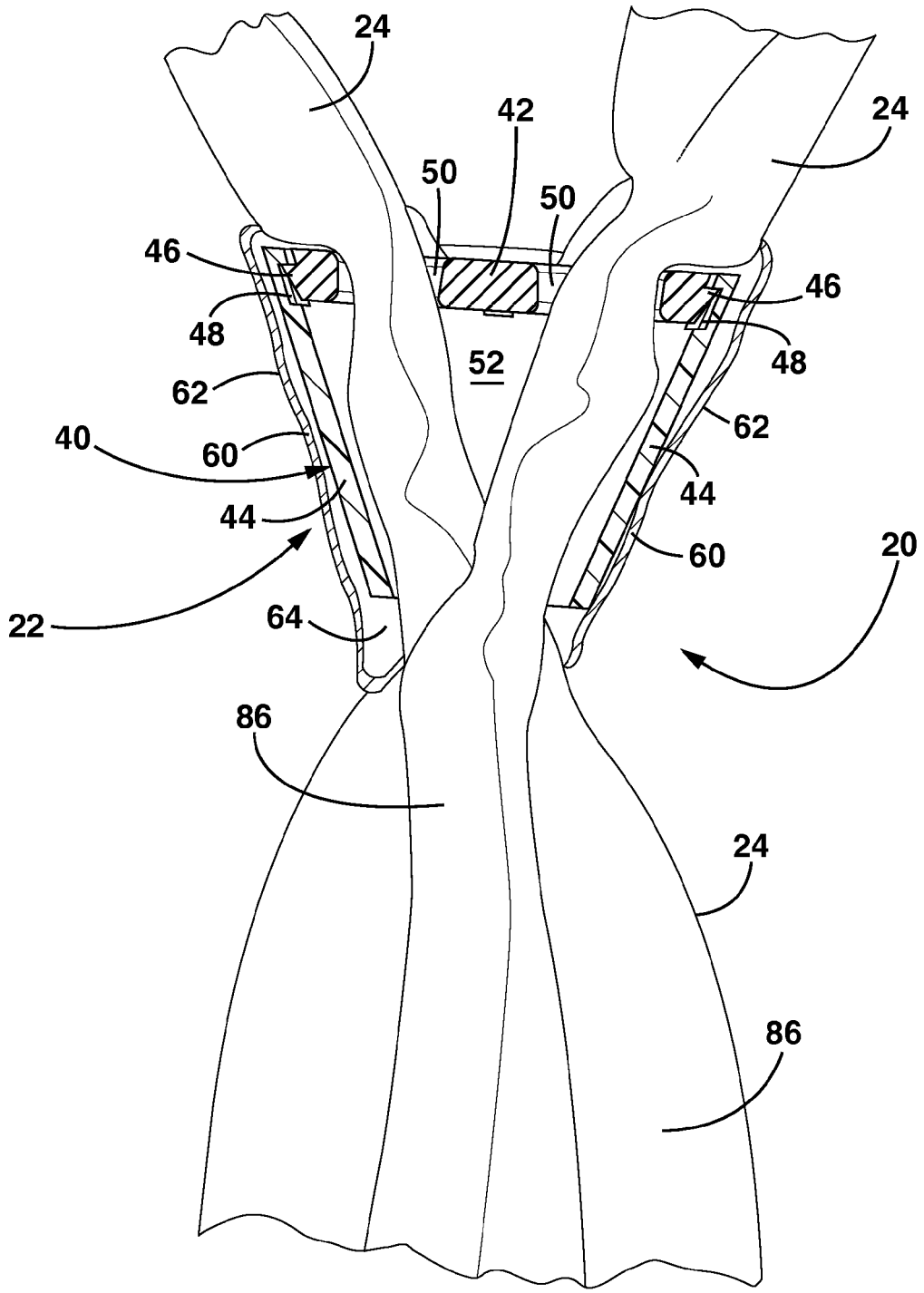
FIG. 17 is a section view taken through the center of the pre-knot with a tie body inserted.

Referring to FIG. 3 through FIG. 9 and FIG. 17 the core of the pre-knot 22 is the pre-knot form 40. FIG. 3 is an exploded perspective view of the pre-knot form 40 and FIG. 4 is an assembled perspective view of the pre-knot form 40. FIG. 5 is a front view of FIG. 4 and FIG. 6 is a back view of FIG. 4. FIG. 7 is a right side view of FIG. 4, left side being equal but opposite. FIG. 8 is a top view of FIG. 4 and FIG. 9 is a bottom view of FIG. 4. FIG. 17 is a section view taken through the center of the pre-knot with a tie body inserted.

The pre-knot form 40 serves as a skeletal structure for the pre-knot 22. The tie body 24 is threaded through one or more channels 50. In one embodiment the tie first end 26 is threaded through the left side channel 50 and the tie second end 28 is threaded through the right side channel 50. The pre-knot form 40 has a cavity 52 that retains therein a portion of tie body 24 and a pair of hooked ends 98 that capture and hold the edges of tie body 24 to align the first tie end 26 with the tie second end 28, in a centralized and parallel way, as the tie body 24 exits the pre-knot form 40. Pre-knot form 40 can be molded in one or more pieces from plastic or any other material suitable for the purpose. In one embodiment pre-knot form 40 is about 1.375 inches in height and about 1.875 inches wide by about 0.6875 inches deep at its top and about 0.875 inches wide by about 0.50 inches deep at its bottom. In one embodiment the over all shape of the top of a pre-knot form 40 is about the shape of a 20 degree ellipse measuring about 1.875 in length and the bottom has an over all shape of about a 35 degree ellipse measuring about 0.875 in length. The bottom ellipse shape is modified open to the back and terminates in a pair of hooked ends 98. In one embodiment pre-knot form 40 is constructed of two pieces, a form top 42 and a form body 44.

In one embodiment a form top 42 has three clips 46 positioned about its perimeter with one clip 46 centered to the front and the two other clips positioned at 90 degree angles to the first clip 46. The purpose of clips 46 is to engage the like positioned sockets 48, in the interior of the form body 44, in a snap fit. In another embodiment, adhesive can substitute for the clips 46 and the sockets 48. A form top 42 has one or more channels 50 that can be any shape or size. In one embodiment there is one right side channel 50 that is circular and measures about 0.4375 in diameter and one left side channel 50 that is about a 60 degree ellipse measuring about 0.50 inches in length. The channels 50 are positioned with a dimension of about 0.375 inches between their edges and a measurement of about 0.3125 inches from the side of each channel 50 to the outside edge of form body 44.

Figure 6A:
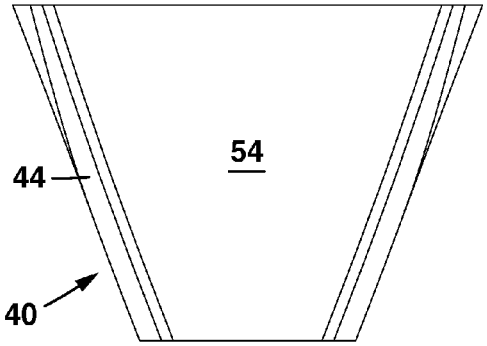
FIG. 6A is a back view of another embodiment.

FIG. 6A is a back view of another embodiment. In this embodiment pre-knot form 40 can have a back panel 54 to close the cavity 52. The back panel 54 can have a right and left edge that snap fit engagement with form body 44 and measure about 1.375 inches in height and about 1.50 inches wide at the top and about 0.50 inches wide at the bottom.

Figure 6B:
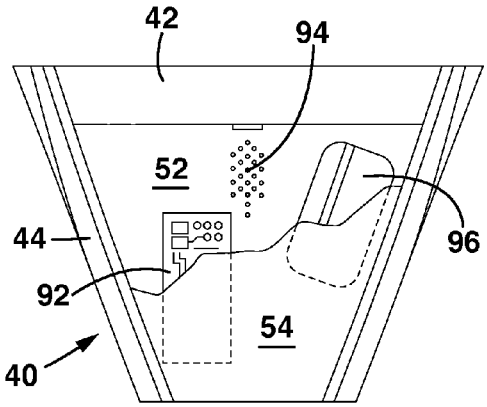
FIG. 6B is a back view, of yet, another embodiment.

FIG. 6B is a back view, of yet, another embodiment. In this embodiment the cavity 52 can be used for the purpose of housing an electronic device 92 or light emitting diodes (LEDs) 94 or other stowage 96 such as credit charging devices, cash, medication, food supplements or beverages.

Figure 12:
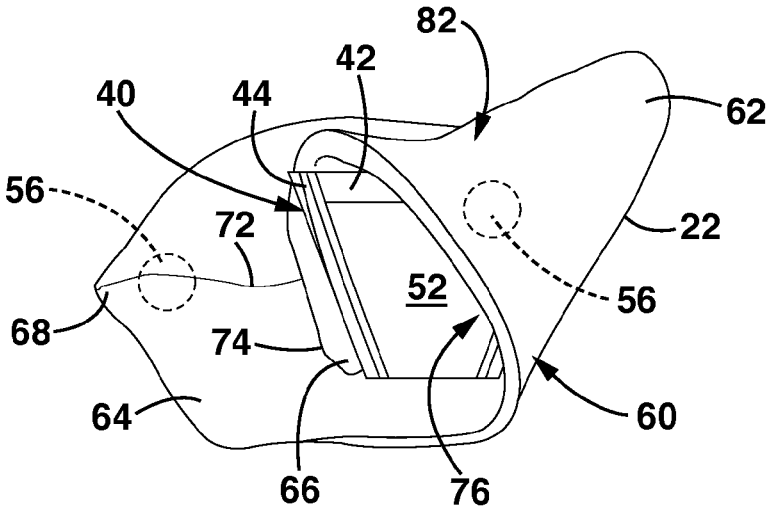
FIG. 12 is a back view of the pre-knot with the second end of its cover unfolded.
Figure 13:
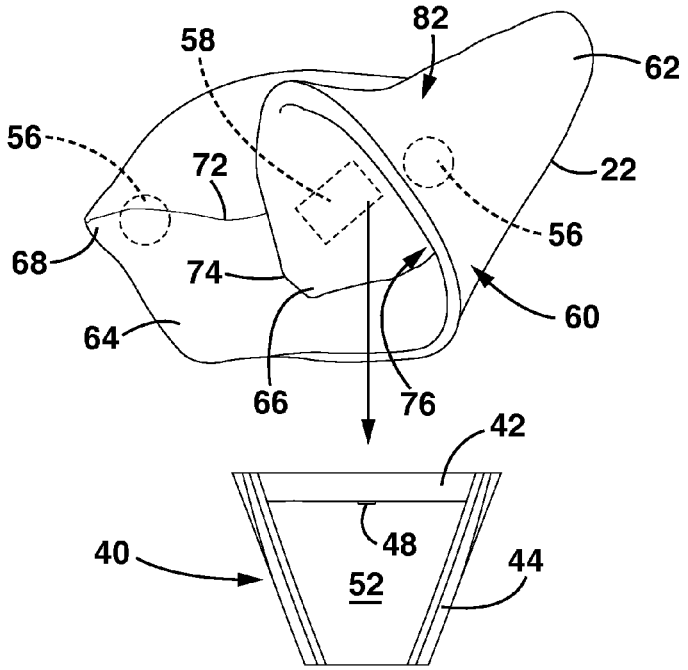
FIG. 13 is a back view of the pre-knot with the knot form removed from its cover.
Figure 14:
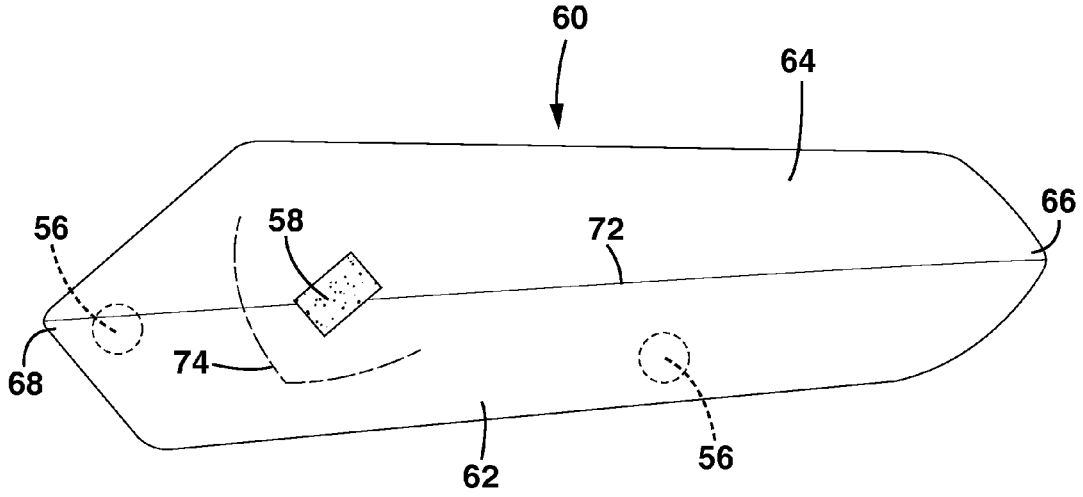
FIG. 14 is a back view of one embodiment of the pre-knot cover.
Figure 15:
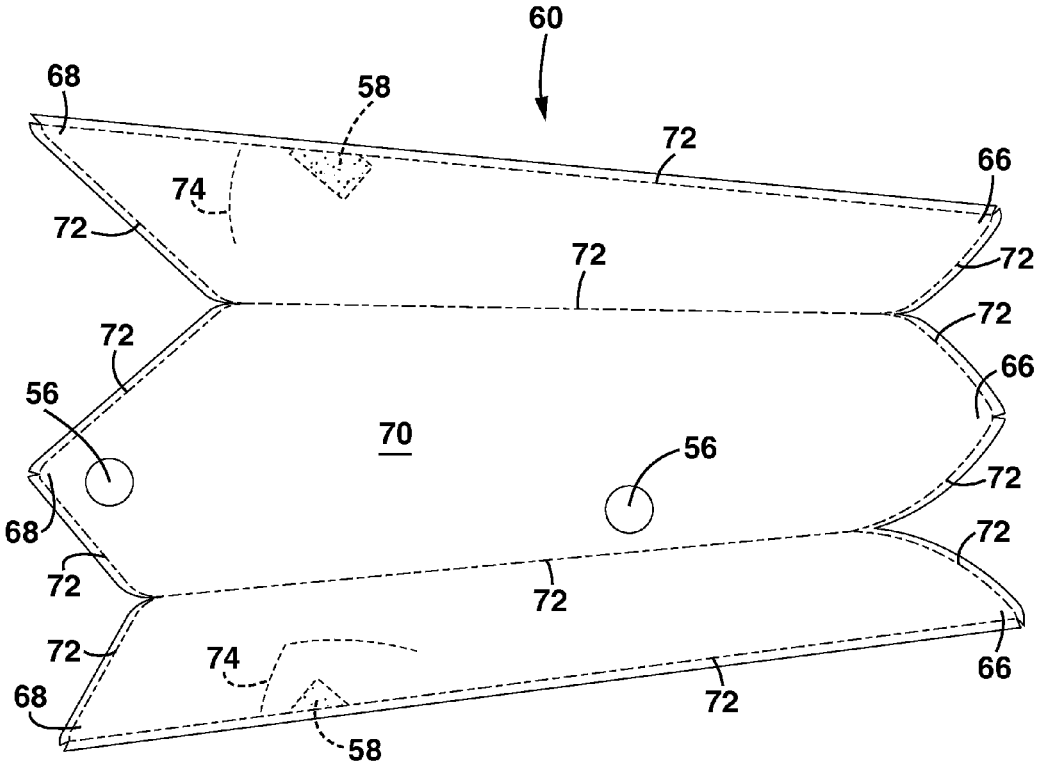
FIG. 15 is a inside pattern view of one embodiment of the pre-knot cover, unfolded.

Referring to FIG. 11 through FIG. 15 the pre-knot 22 is described. FIG. 15 is an inside pattern view of one embodiment of the pre-knot cover 60, unfolded as a single sheet of material. The pre-knot cover 60 has a cover front 62, a cover back 64 and a cover inside 70. In one embodiment a pre-knot cover 60 is constructed of fabric in other embodiments any suitable material can be used such as plastic, carbon fiber or woven material. A pre-knot cover 60 can be any solid color or have a cover surface design 78. While an embodiment of a cover surface design 78 is shown in FIG. 1 and FIG. 2, a cover surface design 78 can be any infinite combination of colors, lines, shapes or forms applicable to pre-knot cover 60. Over all the pre-knot cover 60 is about 7.50 inches long and about 2.25 inches wide in its finished form. In one embodiment the pre-knot cover 60 can be a single sheet of adhesive backed material cut to size like FIG. 14 to wrap pre-knot form 40. In another embodiment, as shown in FIG. 15 the over all width of the unfolded pre-knot cover 60 is about 4.50 inches in width. A pre-knot cover 60 has a cover first end 66 and a cover second end 68. In one embodiment cover folds 72 are used to hem the edges of the material as well as turn the material in on itself to create a cover front 62 and a cover back 64. A pre-knot cover 60 can be stitched closed by sewing or by the use of adhesive to form a pre-knot cover 60 as shown in FIG. 14 a back view of one embodiment of the pre-knot cover 60. Two fasteners 56 are fixed to the cover inside 70. In one embodiment the fasteners 70 are magnets. In other embodiments any other fasteners 70 could be used such as snaps, hook and loop fasteners or staples. One fastener 70 is positioned about 2.8125 inches from a cover first end 66 and about 0.375 inches from the bottom edge as shown in FIG. 14. A second fastener 56 is positioned about 0.5625 inches from a second cover end 68 and about 0.875 inches from the bottom edge as shown in FIG. 14. The cover back 64 is marked with the anchor point 74 as represented in FIG. 14 by a broken line and also has the adhesive 58 placed about 2.25 inches from the cover second end 68.

The pre-knot 22 is assembled in the following steps. As is shown in FIG. 13, a cover first end 66 is folded to contact the cover front 62 at the cover first end 66 with the adhesive 58, aligning cover first end 66 with anchor point 74 forming a cover pocket 76. The purpose of the cover pocket 76 is to house the pre-knot form 40 as is shown in FIG. 12. A cover second end 68 is then tucked into the cover pocket 76 with the fastener at the end of cover second end 68 making contact with the fastener 56 positioned at the top of cover pocket 76. A pre-knot is thus formed as shown in FIG. 12, having an opening at the left and right sides, at the top, and having a single center opening at the bottom. Thus the openings accommodate the insertion of tie body 24 through a pre-knot form 40.

The pre-knotted adjustable necktie 20 can be easily managed by a person 34 of any age or infirmity by simply putting it around the collar and sliding the adjustable pre-knot 22 to any desirable position on the tie body 24. Thus creating an individual fashion statement unable to be provided by the modern day necktie design with its tying limitations and challenges.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A pre-knotted adjustable necktie comprising:

an elongated tie body having a first end and a second end;

a pre-knot form having a first channel and a second channel each extending from a top of the pre-knot form to a bottom of the pre-form, wherein the first and second channels each accept one of the first end and the second end of the tie body in a sliding arrangement so as to provide an adjustable loop to be worn around a user's neck; and a pre-knot cover, wherein the pre-knot cover is folded over the pre-knot form laterally so as to conceal a front and back of the pre-knot form that is exposed when the necktie is worn, wherein the pre-knot cover is formed as a sheet of fabric material having an elongated shape with a first end laterally opposite a second end, and wherein the cover is:

attached at the first end of the cover to a front of the pre-knot form, and passed:

first over the top toward the back of the pre-knot form, between the first end and the second end of the tie body, then, from the back of the pre-knot form, laterally toward one side of the form and around the front of the pre-knot form, therewith creating a cover pocket that houses the pre-knot form, then, from the front of the pre-knot form, laterally around a second side opposite the first side of the form again toward the back of the pre-knot form, and tucked into the cover pocket, and attached at the second end of the cover to the back of the back of the pre-knot form.

2. The pre-knotted adjustable necktie of claim 1, wherein the pre-knot form comprises a conical structure with a cavity therein, and wherein the channels pass through a top and a bottom of the structure.

3. The pre-knotted adjustable necktie of claim of claim 2, wherein the conical structure is open at a back end of the pre-knot form, wherein the opening at the back end of the per-knot form extends uninterrupted from a top of the pre-knot body to a bottom of the pre-knot body.

4. The pre-knotted adjustable necktie of claim 3, wherein the conical structure comprises a pair of hooked ends that retain therein the tie body, and wherein the opening is located between the pair of hooked ends.

5. The pre-knotted adjustable necktie of claim 2, wherein the conical structure is an elliptical conical structure.

6. The pre-knotted adjustable necktie of claim 5, wherein a top and a bottom of the structure each has an elliptical cross section with dimensions at the top greater than dimensions at the bottom of the structure.

7. The pre-knotted adjustable necktie of claim 1, wherein the pre-knot form comprises a top and a form body attached to each other.

8. The pre-knotted adjustable necktie of claim 7, wherein the top of the pre-knot form having a plurality of apertures representing openings for the channels.

9. The pre-knotted adjustable necktie of claim 8, wherein the form body comprises a plurality of sockets that engage with corresponding clips on the top of the pre-knot form.

10. A pre-knotted adjustable necktie comprising:

an elongated tie body having a first end and a second end;

a pre-knot form an elliptical conical structure with a cavity therein forming a first channel and a second channel each extending from a top of the pre-knot form to a bottom of the pre-form, wherein the first and second channels each accept one of the first end and the second end of the tie body in a sliding arrangement so as to provide an adjustable loop to be worn around a user's neck; and a pre-knot cover, wherein the pre-knot cover is folded over the pre-knot form laterally so as to conceal a front and back of the pre-knot form that is exposed when the necktie is worn, wherein the pre-knot cover is formed as a sheet of fabric material having an elongated shape with a first end laterally opposite a second end, and wherein the cover is:

attached at the first end of the cover to a front of the pre-knot form, and passed:

first over the top toward the back of the pre-knot form, between the first end and the second end of the tie body, then, from the back of the pre-knot form, laterally toward one side of the form and around the front of the pre-knot form, therewith creating a cover pocket that houses the pre-knot form, then, from the front of the pre-knot form, laterally around a second side opposite the first side of the form again toward the back of the pre-knot form, and tucked into the cover pocket, and attached at the second end of the cover to the back of the back of the pre-knot form.

11. The pre-knotted adjustable necktie of claim of claim 10, wherein the conical structure is open at a back end of the pre-knot form.

12. The pre-knotted adjustable necktie of claim 11, wherein the conical structure comprises a pair of hooked ends that retain therein the tie body.

13. The pre-knotted adjustable necktie of claim 12, wherein a top and a bottom of the structure each have an elliptical cross section with dimensions at the top greater than dimensions at the bottom of the structure.

* * * * *